US006601929B2

(12) United States Patent
Marihugh

(10) Patent No.: US 6,601,929 B2
(45) Date of Patent: Aug. 5, 2003

(54) MULTIPLE CONFIGURATION SHELVING SYSTEM FOR DISPLAYING AUDIO VISUAL COMPONENTS

(75) Inventor: Daniel W. Marihugh, Chicago, IL (US)

(73) Assignee: Sears, Roebuck and Co., Hoffman Estates, IL (US)

( * ) Notice: Subject to any disclaimer, the term of this patent is extended or adjusted under 35 U.S.C. 154(b) by 0 days.

(21) Appl. No.: 09/819,830

(22) Filed: Mar. 28, 2001

(65) Prior Publication Data

US 2002/0140326 A1 Oct. 3, 2002

(51) Int. Cl.[7] ..... A47B 88/00

(52) U.S. Cl. ..... 312/108; 108/60; 312/140.3

(58) Field of Search ..... 211/87.9, 90.01; 108/41, 60, 136; 312/108, 117, 140.3, 257.1, 265.5, 223.3, 223.6

(56) References Cited

U.S. PATENT DOCUMENTS

| | | | | |
|---|---|---|---|---|
| 687,740 A | * | 12/1901 | French | 312/108 X |
| 1,739,730 A | * | 12/1929 | Orthwine | 312/117 X |
| 2,725,274 A | * | 11/1955 | Stivale | 312/140.3 X |
| 4,728,158 A | * | 3/1988 | D'Elia et al. | 312/108 |
| 4,807,539 A | * | 2/1989 | Del Castillo von Haucke | 108/60 X |
| 6,086,172 A | * | 7/2000 | Lee | 312/108 |

* cited by examiner

*Primary Examiner*—John G. Weiss
*Assistant Examiner*—Michael J. Fisher
(74) *Attorney, Agent, or Firm*—Michael Best & Friedrich LLP

(57) ABSTRACT

A shelving system for displaying audio visual components that may be configured into multiple positions is disclosed. The system includes a base that supports a center platform disposed between right and left platforms. The center platform and the right and left platforms all may assume multiple positions for displaying and demonstrating different audio visual components of varying sizes. In a first upright position, the right and left platforms provide an open three walled platform for holding a large speaker or other component in an inclined position. In second inverted positions, the right and left platforms are useful for supporting a component, such as a smaller speaker, in an elevated position above the base. In a first upright position, the center platform provides an elevated platform for a larger component, such as a monitor with or without other components such as a DVD player and a video cassette recorder. In the first upright position, the center platform also provides space beneath the top panel thereof for accommodating other components such as a center speaker, subwoofer, amplifier and the like. In a second inverted position, the center platform provides a front wall and an elevated support surface. Ceiling mounted speaker enclosures are also provided which enable a retailer to easily suspend smaller speaker components from the ceiling either in front of or behind the multiple configuration shelving system.

62 Claims, 8 Drawing Sheets

MULTIPLE CONFIGURATION SHELVING SYSTEM FOR DISPLAYING AUDIO VISUAL COMPONENTS

FIELD OF THE INVENTION

The present invention relates generally to a shelving system for demonstrating and displaying audio visual components. More specifically, the present invention relates to a multiple configuration shelving system capable of displaying a wide variety of audio visual components of varying sizes. Still more specifically, the present invention provides a multiple configuration shelving system for displaying and demonstrating various home theater systems.

BACKGROUND OF THE INVENTION

The marketing and selling of audio visual components or so-called home electronics components has changed dramatically with the introduction of the so-called home theater systems. Specifically, instead of purchasing stereo or high-fidelity audio equipment, television sets, video cassette recorders and DVD players separately, consumers often purchase these components together as an integrated system. Further, consumers may also enhance their existing television by purchasing a sound system that is coupled to the television set and that may include an amplifier, a subwoofer and/or anywhere from 2 to 5 or more additional speakers. The amplifier, subwoofer and speaker systems may or may not include a DVD player. Some systems are sold with a specially designed stand for housing or supporting the television, amplifier, subwoofer and other components such as a VCR or DVD player. Further, the currently available speaker systems vary greatly in size and dimension.

As a result, the retailers of consumer electronics are presented with a difficult task in terms of displaying or demonstrating the currently available home theater systems, accessories and supplementary components. For a consumer to appreciate the sound qualities of many systems, the speakers must be arranged so that they are directed towards the consumer. Because the size of the speakers vary greatly, retailers often must construct custom shelving for individual brands or styles of speaker systems. Further, retailers must often build or create separate shelving systems for those home theater systems that include a subwoofer, which should be disposed beneath the television set or monitor and those systems which do not include such a subwoofer. Additional space beneath the television must also be provided for a center speaker, if one is provided with a system. Further, many home theater systems include rear speakers which, to be appreciated, must be mounted either overhead or behind the space where the consumer would be standing when demonstrating an individual home theater system. Shelving may also be needed for an amplifier, DVD player and VCR.

Consequently, standard shelving systems that are currently employed by electronics retailers are simply unsatisfactory for demonstrating and displaying home theater systems and other audio visual components used to complement consumers' existing home theater systems or consumers' existing television/VCR/DVD systems. Because the style and type of audio visual components is constantly changing, it is not cost efficient for retailers to custom build shelving for a particular system because the size and dimensions of the system will inevitably change from year to year in response to consumer demand and in response to technological developments.

Accordingly, a need exists for a multiple configuration shelving system which can be easily reconfigured by retail personnel for displaying different audio visual components such as different home theater systems.

SUMMARY OF THE DISCLOSURE

The present invention satisfies the aforenoted need by providing a shelving system for demonstrating and displaying audio visual components that may be easily reconfigured into a plurality of different positions and configurations. The disclosed shelving system comprises a base, a center platform, a right platform and a left platform. The base comprises a flat surface for supporting the center, right and left platforms. The center platform is disposed between the right and left platforms. The center platform comprises a first horizontal panel and a second horizontal panel. The first and second horizontal panels of the center platform are connected by a vertical panel. The right platform comprises a right horizontal panel, a right side vertical panel and a right end vertical panel. The right horizontal panel comprises a side edge connected normally to the right side vertical panel and the right horizontal panel further comprises an end connected normally to the right end vertical panel. The right side vertical panel and the right end vertical panel are also connected normally together.

Similarly, the left platform comprises a left horizontal panel, a left side vertical panel and a left end vertical panel. The left horizontal panel comprises a side edge connected normally to the left side vertical panel. The left horizontal panel further comprises an end connected normally to the left end vertical panel. Further, the left side vertical panel and the left end vertical panel are connected normally together.

All three platforms rest on top of the base. Preferably, the platforms are not fixedly connected to the base so that they may be rotated or reconfigured to assume different positions. Specifically, one preferred right and left platform configuration, as disclosed above, are three sided structures. In a first upright position, the horizontal panels of the right and left platforms rest on the base and the vertical and end panels of the right and left platforms extend upward therefrom to create a speaker platform with an open front and an open side. In contrast, in a second inverted position, the speaker platforms may be rotated so that the horizontal panel is spaced vertically above the base and upper edges of the vertical side panels and end panels rest on the base. The end panel can create a solid front wall and the vertical side panel can create a solid side wall. The horizontal panel of the right and left platforms may then be used to create an elevated platform for a speaker or other component.

Similarly, the center platform has at least two different positions. Specifically, with the first horizontal panel resting on the base, the vertical panel serves as a back wall and the second horizontal panels serves as an elevated platform for a component, such as a television set. The front end is open and may optionally include a shelf for supporting a subwoofer, an amplifier and/or a center speaker beneath the television set and/or other components disposed on top of the second horizontal panel. The center platform may also be reconfigured by rotating the platform so that the second horizontal panel rests on the base, the first horizontal panel provides an elevated platform and the vertical panel provides a solid front wall. In this configuration, an elevated platform for a television set is provided without shelving space below the television.

In a further refinement of the disclosed system, the horizontal panels of the right and left platforms each include a first surface which either engages the base when the right and left platforms are in the first upright position or which provide an elevated horizontal support for a component, such as a speaker, in the second inverted position. The horizontal panels also include a second incline surface that faces away from the upper surface of the base when the right and left platforms are in their respective first upright positions. The inclined surfaces of the right and left platforms provide an inclined support for a component, such as a speaker and which facilitates the directing of a speaker at an appropriate angle for demonstration purposes.

In another refinement of the disclosed shelving system, the center platform further comprises right and left side panels for structural stability and also which may provide a means for securing the right and left platforms to the center platform. For example, connecting rods or pins may be used to detachable connect the right and left platforms to the center platform. A convenient location for such connecting rods or pins would be through either the right and left side vertical panels of the right and left platforms and into the right and left side panels of the center platform, respectively. As an alternative, connecting rods could be passed through the right and left horizontal panels of the right and left speaker platforms, respectively, and into the right and left side panels of the center platform, respectively. Other non-permanent and easy to disassemble mechanisms for securing the right and left platforms to the center platform will be apparent to those skilled in the art.

In another refinement of the disclosed system, holes may be provided in the right and left side panels of the center platform, the right and left side vertical panels of the right and left platforms, as well as the first and second horizontal panels of the center platform for accommodating component wiring.

In a further refinement of the disclosed system, the center platform may be secured in place on the upper surface of the base by a tongue and groove connection. In yet a further refinement along these lines, the upper surface of the base may further comprise a slot for receiving a cleat used to hold the center platform in place on the upper surface of the base.

In yet another refinement of the disclosed system, the center platform may be removed to provide an open space between the left and right platforms. An open flat support surface is provided between the right and left platforms which may be used for displaying a large monitor or television set or a monitor or television set and other components that are provided with a stand or rack. The right and left platforms can then be used to display speakers.

In yet a further refinement of the disclosed system, ceiling mounted speaker enclosures may be provided for displaying or demonstrating rear speakers of a multiple speaker sound system. The ceiling mounted speaker enclosures may comprise a front section comprising a grid, a back section connected to the front section and two side walls disposed on opposite sides of and connected normally to the front and rear sections. The front and rear sections and the two side walls form an open top that is connected to the ceiling. The front and rear sections and the two side walls also form an enclosure for accommodating a speaker. The speaker is directed toward the grid of the front section so that sound may travel outward towards the consumer in an unencumbered fashion.

In a refinement, the speaker enclosures may be connected to the ceiling structure with a plurality of easy to fabricate clips.

BRIEF DESCRIPTION OF THE DRAWINGS

For a more complete understanding of the disclosed shelving system, reference should now be made to the embodiments illustrated in greater detail in the accompanying drawings wherein.

It should be understood that the drawings are not necessarily to scale and that the embodiments are sometimes illustrated using phantom lines and fragmentary views. In certain instances, details which are not necessary for an understanding of the disclosed shelving system or which render other details difficult to perceive may have been omitted. It should be understood, of course, that the present invention is not necessarily limited to the particular embodiments illustrated herein.

DETAILED DESCRIPTION OF THE PRESENTLY PREFERRED EMBODIMENTS

Figure 1:
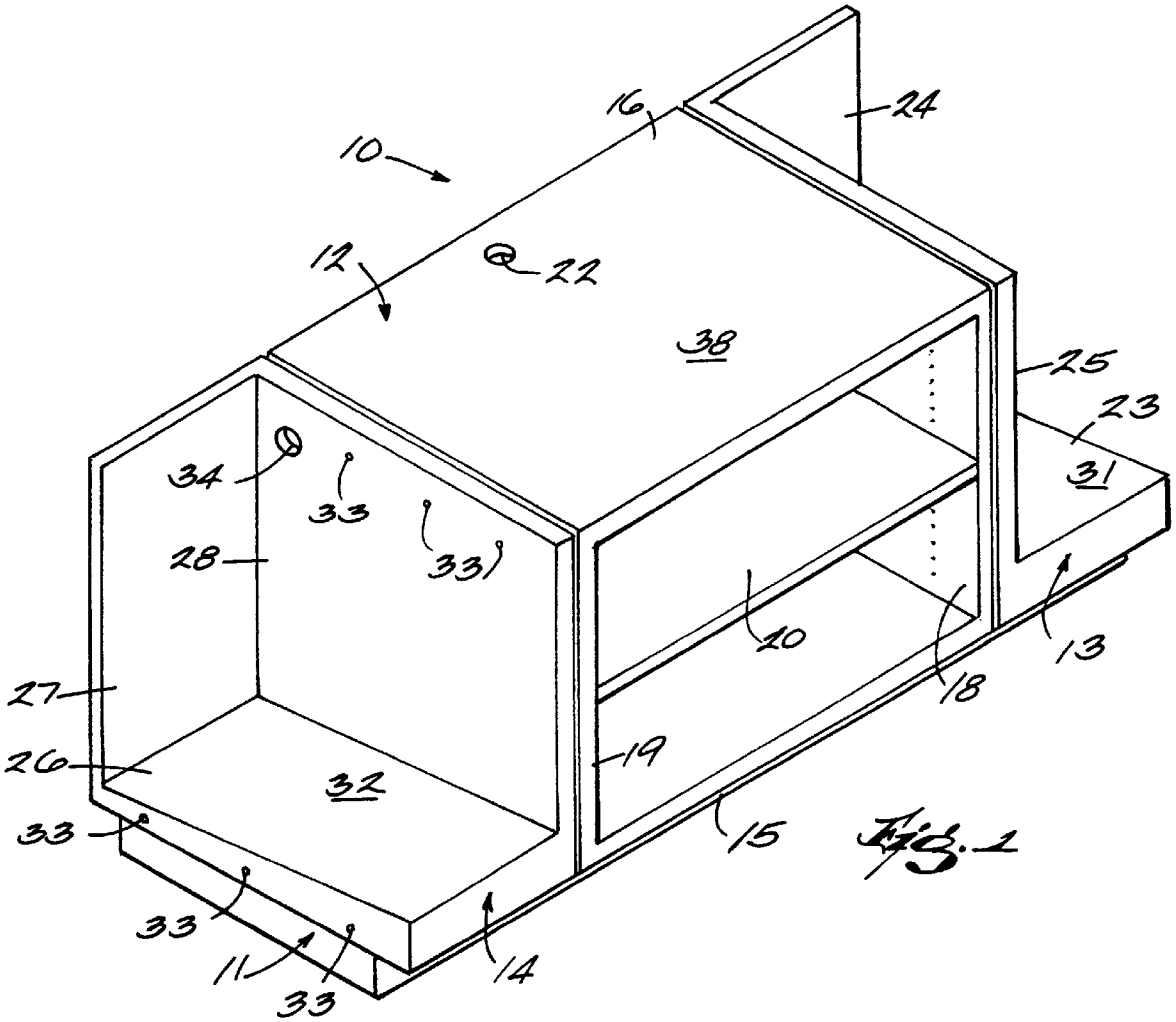
FIG. 1 is a perspective view of a shelving made in accordance with the present invention and with the right and left platforms in a first upright position and the center platform in a first upright position.

Turning first to FIG. 1, a shelving system 10 is shown which includes a base 11 which supports a center platform 12 disposed between a right platform 13 and a left platform 14. In the configuration illustrated in FIG. 1, the center platform 12, right platform 13 and left platform 14 are all disposed in their so-called first upright positions.

The center platform includes a first horizontal panel 15 and a second horizontal panel 16. The first horizontal panel 15 is connected to the second horizontal panel 16 by a vertical panel 21 (see FIG. 3) as well as a right side panel 18 and left side panel 19. The center platform 12 may also include a center shelf 20. In the first upright position shown in FIG. 1, the center platform 12 is ideally configured to support a television or other component on the second horizontal panel 16 and one or more speakers on the shelf 20 and first horizontal panel 15. In addition, am amplifier or a subwoofer could be supported on either the shelf 20 or first horizontal panel 15. In the event that a large subwoofer or other component is to be displayed, the shelf 20 could be easily removed and such a larger component could be accommodated between the first horizontal panel 15 and second horizontal panel 16. The second or top horizontal panel 16 includes a hole 22 for accommodating component wiring.

The right platform 13 includes a right horizontal panel 23 which is connected normally to a right end panel 24 as well as a right side vertical panel 25 to form a 3-walled platform. Turning to the left platform 14, the left horizontal panel 26 is connected to a left end vertical panel 27 as well as a left side vertical panel 28 to also form a 3-walled platform. Preferably, the left side vertical panel 28 and the left end vertical panel 27 are normally connected and normally connected to the left horizontal panel 26. It will be noted that the right horizontal panel 23 comprises a first horizontal surface 31 and the left horizontal panel 26 also comprises a first horizontal surface 32. As best seen when viewing the left platform 14, the horizontal surfaces 31, 32 are preferably inclined. The inclined surfaces 31, 32 provide support for a speaker in an inclined position. Retailers have found this configuration to be helpful because it directs a speaker towards a consumer who would be standing in front of the shelving system 10.

Figure 6:
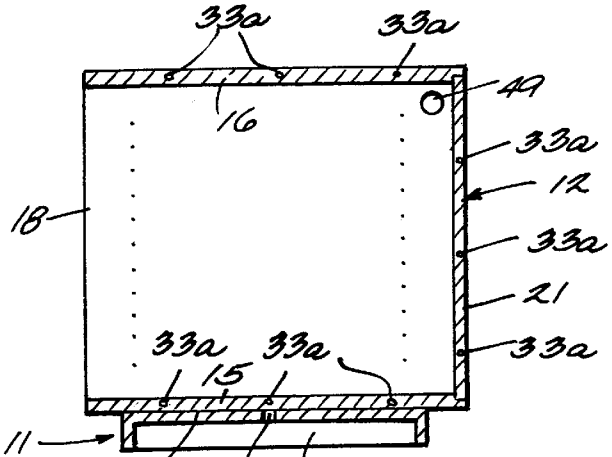
FIG. 6 is a side sectional view of the shelving system shown FIG. 1.
Figure 10:
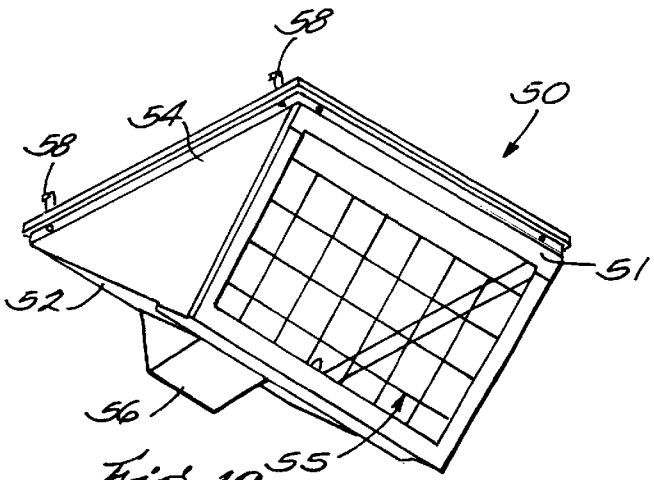
FIG. 10 is a perspective view of a ceiling mounted speaker enclosure made in accordance with the present invention.

The right and left platforms 13, 14 and center platform 12 are not fixedly connected to the base 11. Instead, the right platform 13 and left platform 14 are preferably detachably connected to the center platform 12 using connecting rods or pins 33*a* (not shown in FIG. 1; see FIG. 8) that extend outward from the center platform 16 and that are received in holes 33 disposed in the horizontal panels 23, 26 or the vertical panels 25, 28 of the right and left platforms 23, 26 respectively. The pins or connecting rods 33*a* are preferably disposed in the horizontal panel 16 of the center platform 12 but as shown in FIG. 6, may also be disposed in the horizontal panel 15 or rear panel 21 of the center platform 12 as well.

Figure 5:
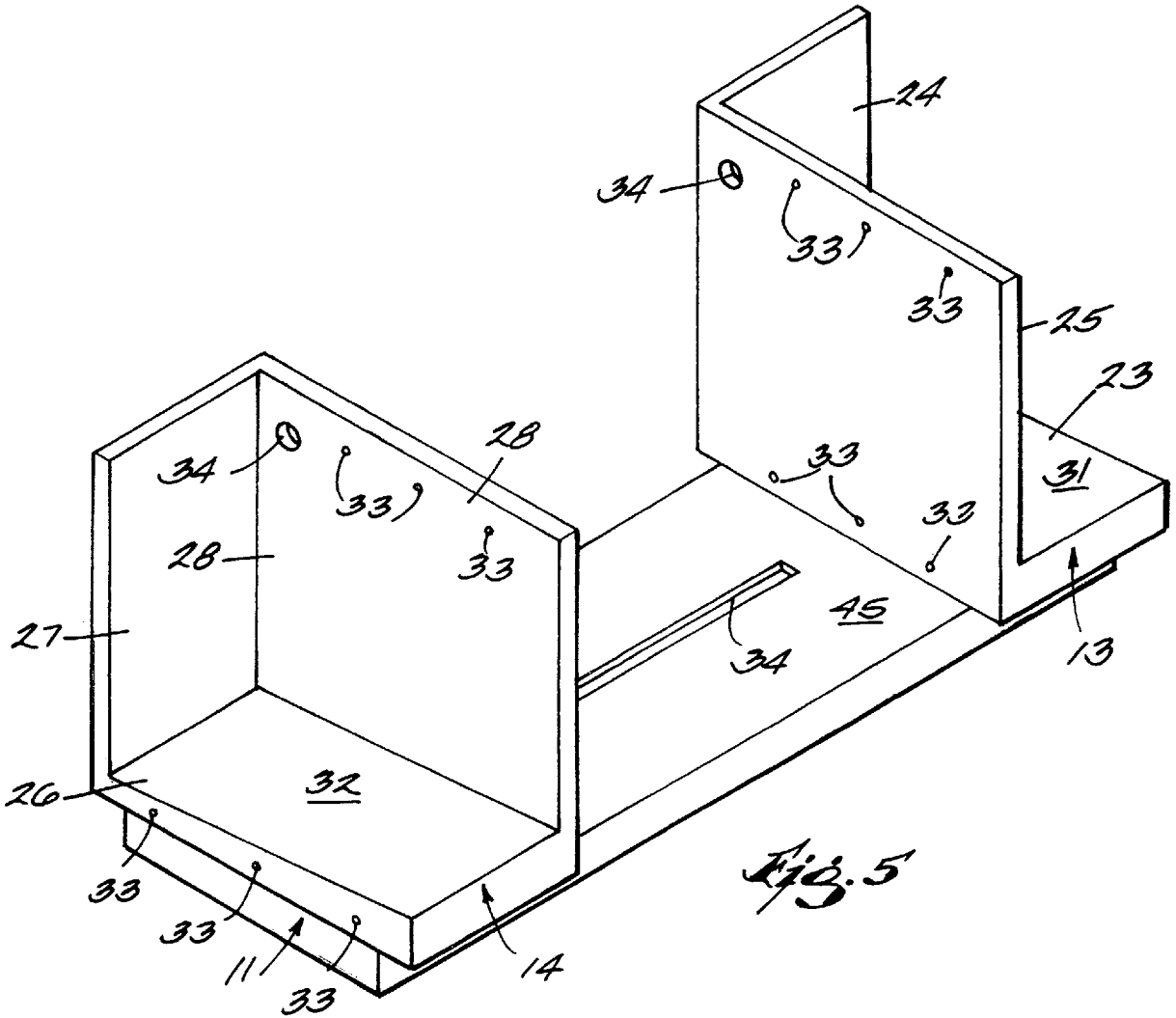
FIG. 5 is another perspective view of the shelving system shown in FIG. 1 with the right and left platforms in a first upright position and the center platform removed.

Turning briefly to FIG. 5, the base 11 may include a slot or groove 34 for receiving an alignment cleat that may be connected to one or both of the horizontal panels 15, 16 of the center platform 12 or may also be received in a similar groove or slot disposed in the horizontal panels 15, 16 of the center platform 12. In any event, the preferred connection or placement mechanism for the center platform 12 on the base 11 is a tongue and groove connection which enables the center platform 12 to be easily disconnected from the base 11 and rotated to assume the position shown in FIG. 3 which will be discussed below. A similar tongue and groove connection or alignment mechanism can be used to secure the placement of the right platform 13 and left platform 14 on top of the base 11 or, as shown in FIG. 1, one or more connecting rods or pins 33 can be used to secure the right and left platforms 13, 14 to the center platform 12 which is secured in place on the base 11 by a tongue and groove or similar connection mechanism. Finally, it will be noted that the right side vertical panel 26 and left side vertical 28 of the right and left platforms 13, 14 preferably include a hole 34 for accommodating component wiring.

Figure 2:
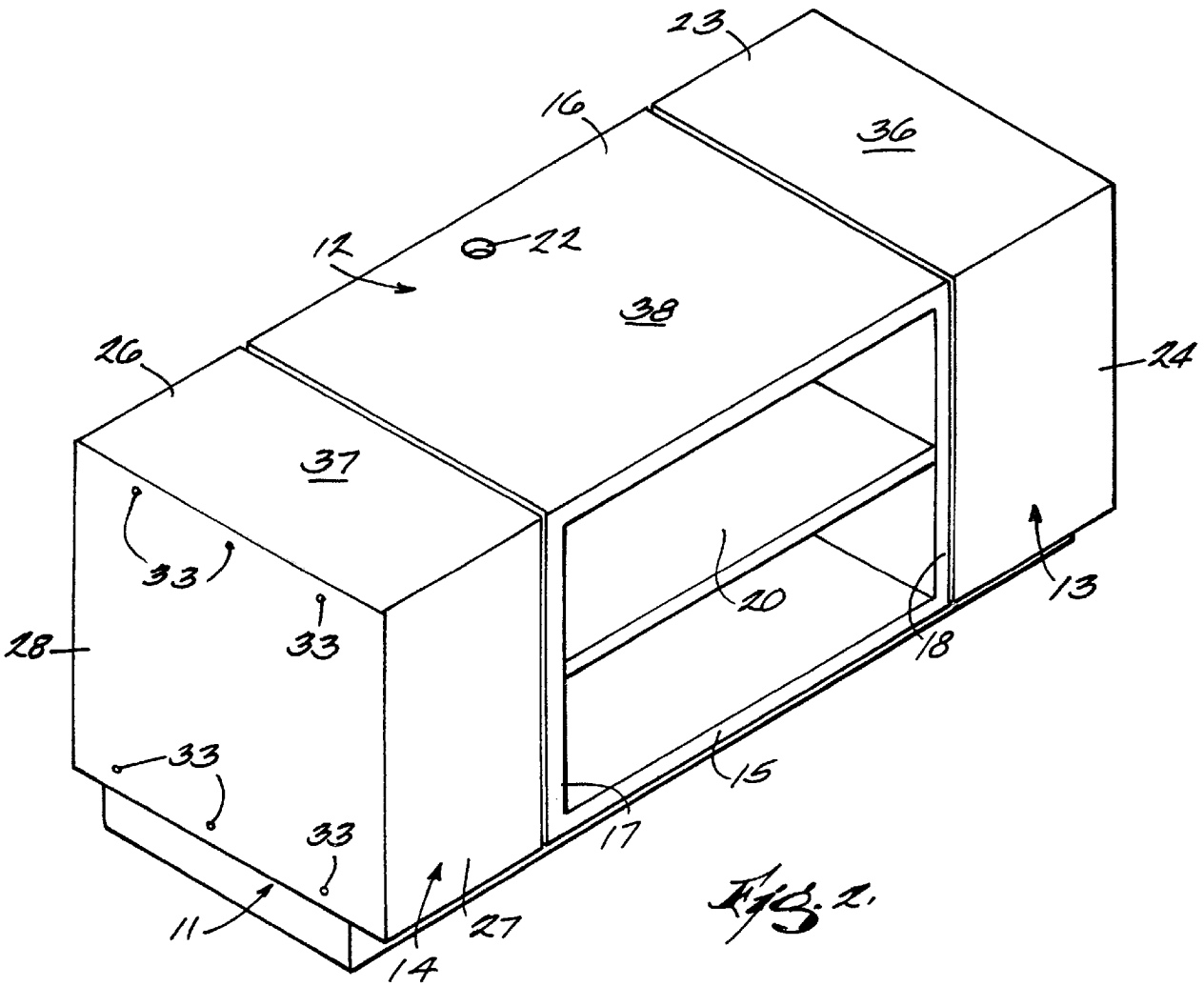
FIG. 2 is another perspective view of the shelving system shown in FIG. 1 with the center platform in a first upright position and the right and left platforms in a second inverted position.

Turning to FIG. 2, the right platform 13 and left platform 14 are shown in their second inverted positions or, with the horizontal panels 23, 26 disposed in an elevated position with respect to the base 11. The second surfaces 36, 37 of the panels 23, 26 respectively provide an elevated surface for supporting a small component, such as a small speaker. In a preferred embodiment, the surfaces 36, 37 of the right horizontal panel 23 and left horizontal panel 26 respectively are aligned with the surface 38 of the horizontal panel 16 of the center platform 12.

Figure 3:
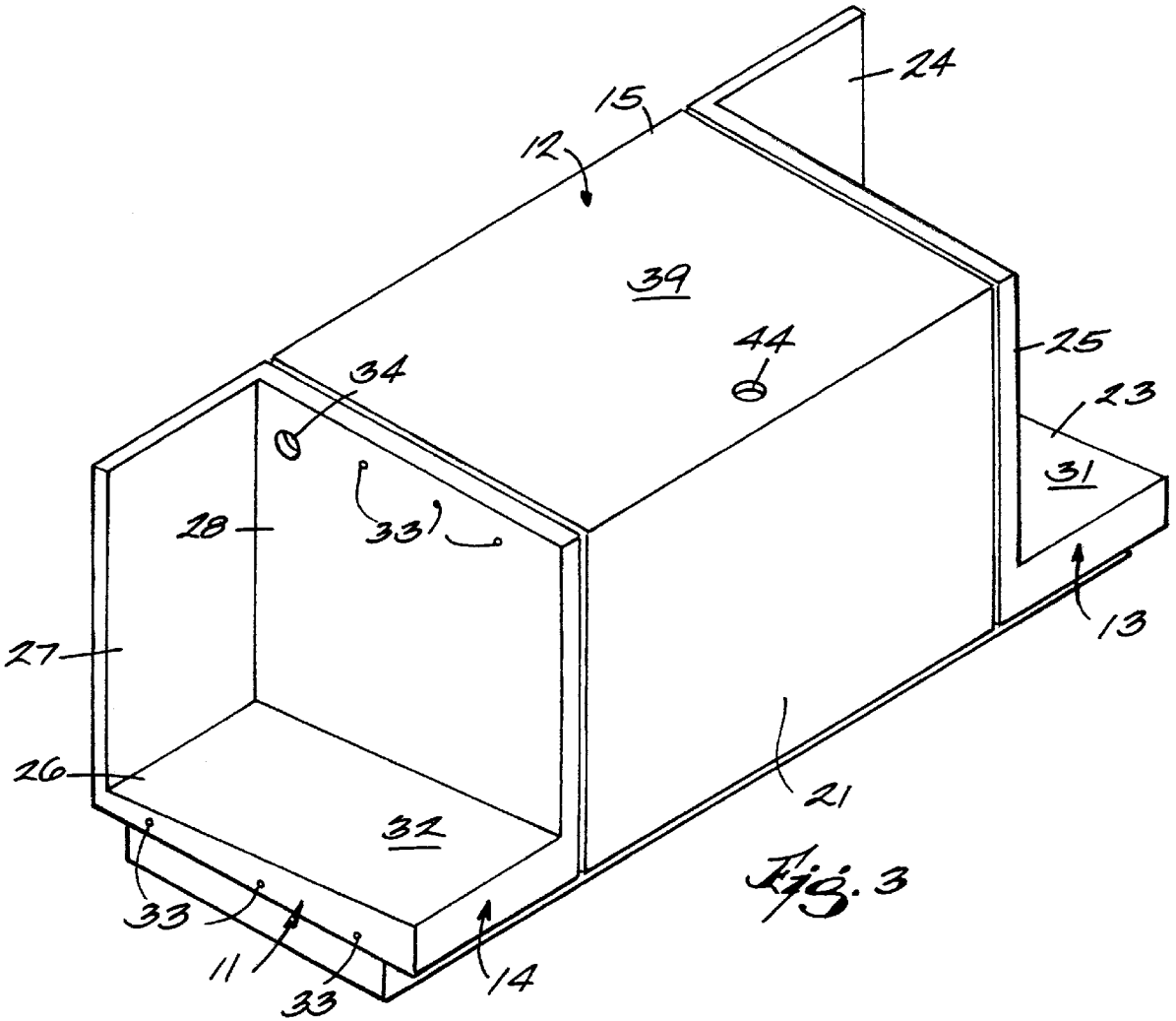
FIG. 3 is another perspective view of the shelving system shown in FIG. 1 with the right and left platforms in a first upright position and the center platform in a second inverted position.

Turning to FIG. 3, the right platform 13 and left platform 14 are again disposed in their first upright position and the center platform 12 has been rotated to assume a second inverted position. That is, the first horizontal panel 15 is disposed in the elevated position above the base 11. The outwardly facing surface 39 of the first horizontal panel 15 can be used to provide an elevated support for a component, such as a television set or any one or more components such as a television set, DVD player, video cassette recorder, amplifier and/or small speakers. One application for the configuration shown in FIG. 3 is to display a television set or monitor on the surface 39 of the center platform 12 and large stereo speakers in the platforms 13, 14. Other applications will be apparent to those skilled in the art.

Figure 4:
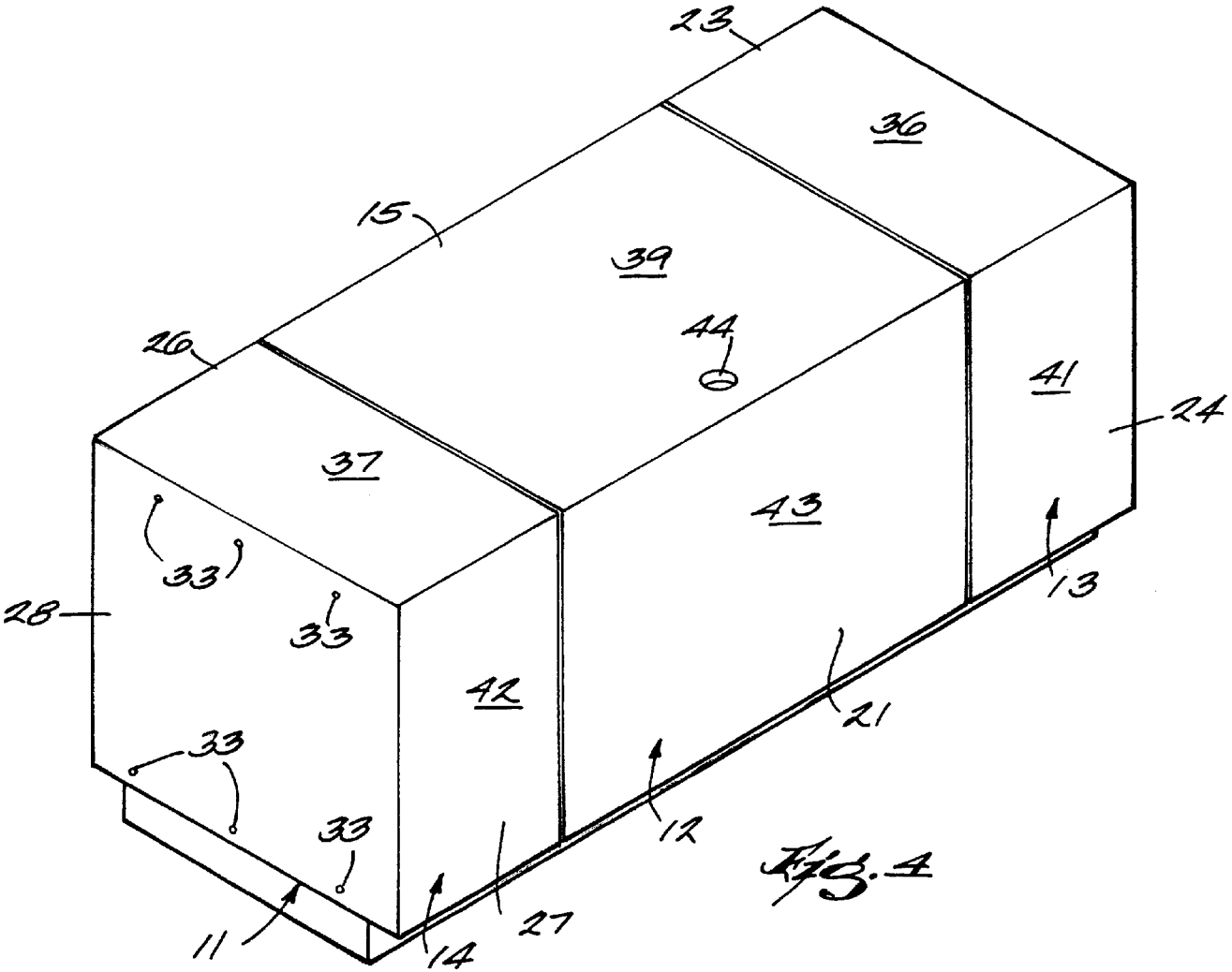
FIG. 4 is another perspective view of the shelving system of FIG. 1 with the right, left and center platforms all in a second inverted position.

Turning to FIG. 4, the right and left platforms 13, 14 and center platform 12 have all been rotated to assume their second inverted positions. Preferably, the surfaces 36, 37 and 39 are substantially coplanar as are the surfaces 41, 42, 43. It will also be noted that the first horizontal panel 15 of the center platform 12 may also include a hole 44 for accommodating component wiring. One application for the configuration illustrated in FIG. 4 would be to display a television set or any combination of a television set, DVD player and video cassette recorder on the surface 39 of the center platform 12 along with speakers disposed on the surfaces 36, 37 of the platforms 13, 14 respectively. Other applications will be apparent to those skilled in the art as well.

Turning to FIG. 5, the center platform 12 has been removed and the right and left platforms 13, 14 are disposed in their first upright position. The configuration of FIG. 5 would be useful to display a system where the monitor or television set and other components such as an amplifier, DVD player, video cassette recorder, subwoofer and/or center speaker are provided in a stand. In such a case, the stand could be placed on the upper surface 45 of the base 11 and larger speakers could be disposed on the inclined surfaces 31, 32 of the right and left platforms 13, 14 respectively. Holes for accommodating connecting pins or rods for securing the right and left platforms 13, 14 to the center platform 12 are shown at 33. Preferably, the base 11 is supported by casters which enable the system 10 to be easily moved about a showroom floor.

Figure 7:
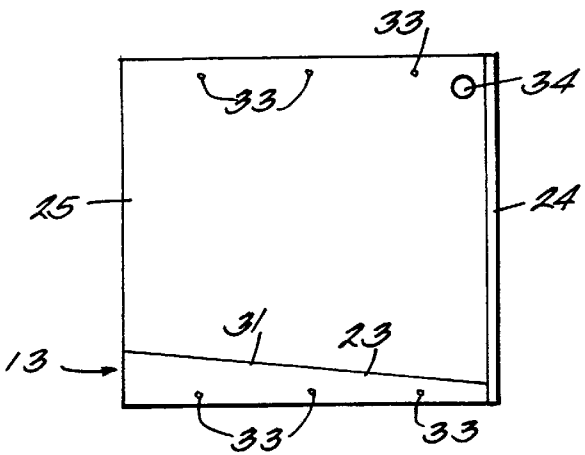
FIG. 7 is a right side view of right platform of the shelving system shown in FIG. 1.
Figure 8:
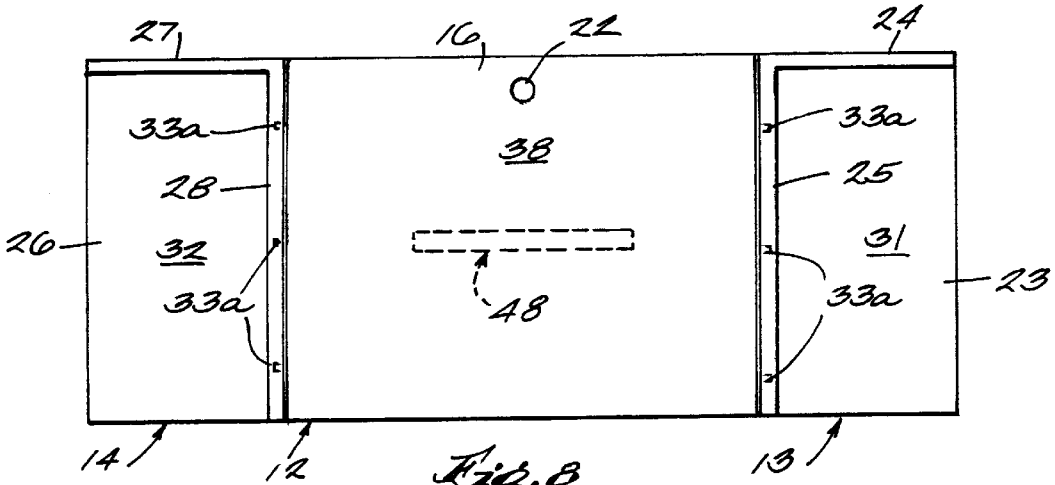
FIG. 8 is a top plan view of the shelving system shown in FIG. 1.
Figure 9:
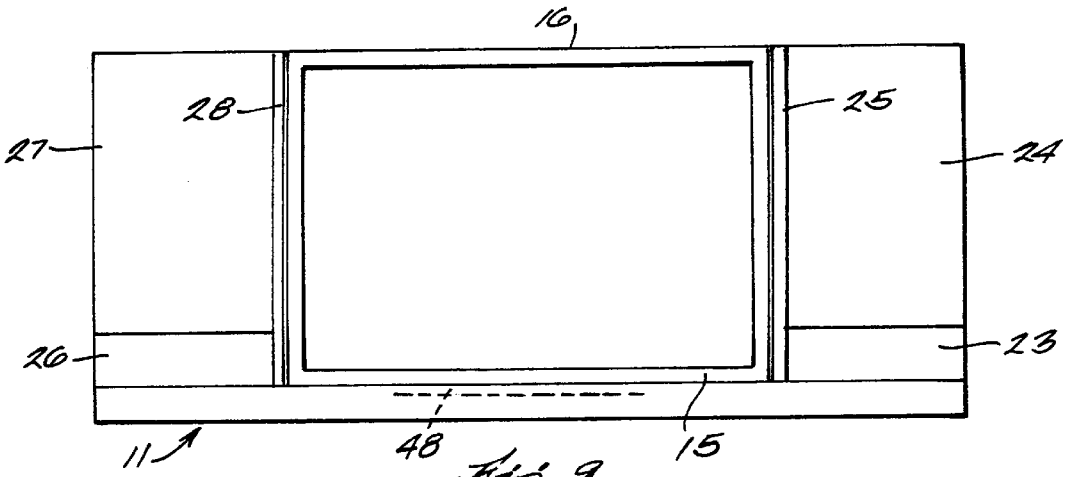
FIG. 9 is a front plan view of the shelving system shown in FIG. 1.
Figure 13:
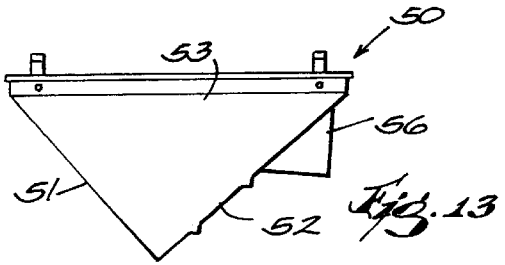
FIG. 13 is a right side plane view of a ceiling mounted speaker enclosure shown in FIG. 10.

Turning to FIG. 6, it will be noted that the undersurface 38 of the first horizontal panel 15 of the center platform 12 may be connected to a cleat 48 which is received in the slot 34 disposed in the base 11. Further, holes 33 may be disposed in the first horizontal panel 15 and/or second horizontal panel 17 for receiving connecting pins or rods 33*a* as discussed above. An additional hole 49 may be disposed in the side panel 18 for accommodating speaker wiring. The hole 49 would be in matching registry with the hole 34 of the right platform 13 as shown in FIG. 7. In FIGS. 8 and 9, one relative position of the alignment cleat 48 is shown.

Figure 14:
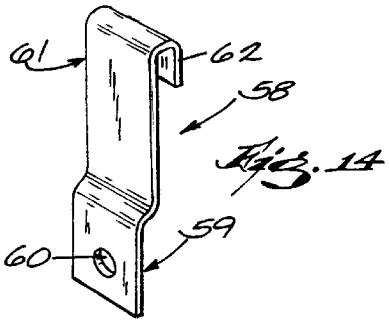
FIG. 14 is a perspective view of a clip used to connect the ceiling mounted speaker enclosure shown in FIG. 10 to a ceiling.

FIGS. 10–15 illustrate the speaker enclosure for mounting a rear speaker of a sound system to store ceiling or other similar structure. The speaker enclosure 50 includes a front section 51 that is connected to a rear section 52 at about a 90° angle thereby providing for triangular right 53 (see FIG. 13) and left 54 (see FIG. 10) sidewalls. The front section 51 includes a grid 55. The enclosed speaker faces towards this grid so sound can proceed outward from the enclosure 50 in an unencumbered fashion. Optionally, the rear section 52 may include a junction box 56 for accommodating a speaker connection. The enclosures 50 may be easily mounted to ceiling rails used to support acoustic tiles by way of the clips shown at 58. Referring to FIG. 14, the clips 58 include a bottom end 59 which may be secured to the enclosure 50 using a conventional fastening means and the hole 60. The top end 61 of the clip 58 includes an inverted u-shaped hook 62 which receives a ceiling rail.

Figure 15:
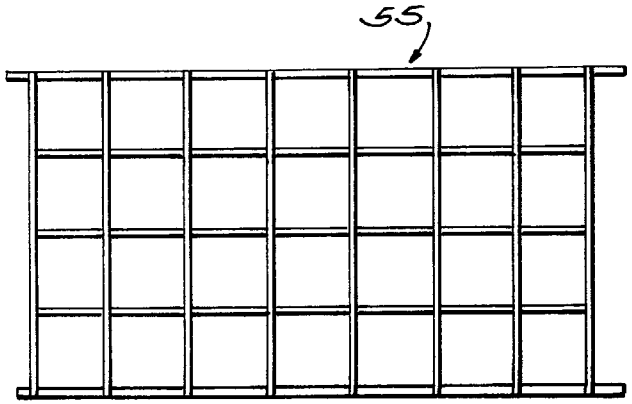
FIG. 15 is a plan view of the front panel grid of the ceiling mounted speaker enclosure shown in FIG. 10.
Figure 11:
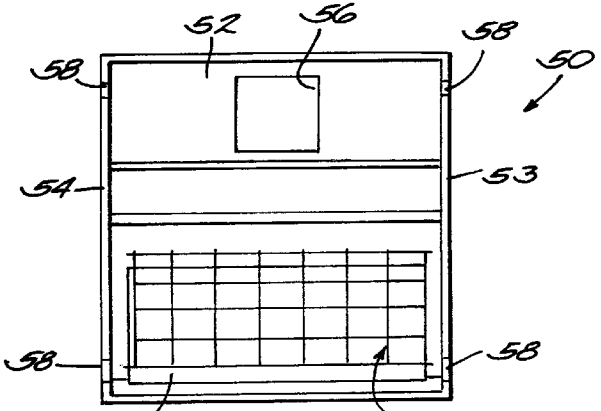
FIG. 11 is a top plan view of the ceiling mounted enclosure shown in FIG. 10.
Figure 12:
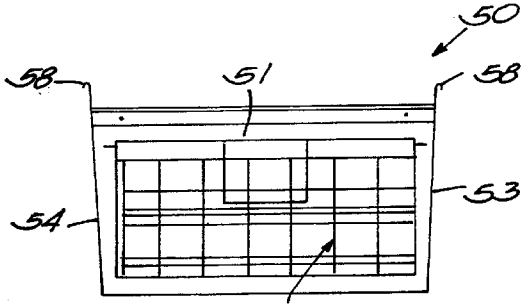
FIG. 12 is a front plan view of the ceiling mounted speaker enclosure shown in FIG. 10.

As shown in FIGS. 11 and 12, four hooks 58 are utilized, however, the number may vary. As also shown in FIG. 11, the front and rear sections 51, 52 and sidewalls 53, 54 form an open top for receiving a speaker. One example of a grid 55 is shown in FIG. 15. However, a screen or other similar device capable of restraining a speaker in the enclosure 50 would suffice.

Numerous modifications and alternative embodiments of the invention will be apparent to those skilled in the art in view of the foregoing description. Accordingly, this description is to be construed as illustrative only is not to be limiting of the invention. Thus, the details herein given may be varied substantially without departing from the spirit and scope of the present invention. Accordingly, the exclusive use of all modifications which are within the scope of the appended claims is reserved.

What is claimed:

1. A shelving system comprising:

a base, a center platform, a right platform, and a left platform, the base including a flat surface for supporting the center, right and left platforms with the center platform being disposed between the right and left platforms, the base further including a front edge and a rear edge, the center platform including a first horizontal panel and a second horizontal panel, the first and second horizontal panels of the center platform being connected by a vertical panel, the center platform being movable between at least two positions including a first upright position where the first horizontal panel engages the base, the vertical panel being disposed proximate the rear edge of the base and the second horizontal is disposed above the base, and a second inverted position where the second horizontal panel engages the base, the vertical panel is disposed proximate the front edge of the base and the first horizontal panel is disposed above the base, the right platform including a right horizontal panel, a right side vertical panel and a right end vertical panel, the right horizontal panel including a side edge connected normally to the right side vertical panel, the right horizontal panel further including an end connected normally to the right end vertical panel, the right side vertical panel and right end vertical panel being connected normally together, the left platform including a left horizontal panel, a left side vertical panel and a left end vertical panel, the left horizontal panel including a side edge connected normally to the left side vertical panel, the left horizontal panel further including an end connected normally to the left end vertical panel, the left side vertical panel and left end vertical panel being connected normally together.

2. The shelving system of claim 1 wherein the right horizontal panel of the right platform further includes a first horizontal surface that engages the upper surface of the base when the right platform is in a first upright position and that further provides a horizontal support in a position spaced vertically above the base when the right platform is in a second inverted position, the right horizontal panel of the right platform further including a second inclined surface that faces away from the upper surface of the base when the right platform is in its first upright position, the second inclined surface of the right platform providing a support in an inclined position when the right platform is in its first upright position.

3. The shelving system of claim 1 wherein the left horizontal panel of the left platform further includes a first horizontal surface that engages the upper surface of the base when the left platform is in a first upright position and that further provides a horizontal support in a position spaced vertically above the base when the left platform is in a second inverted position, the left horizontal panel of the left platform further including a second inclined surface that faces away from the upper surface of the base when the left platform is in its first upright position, the second inclined surface of the left platform providing a support in an inclined position when the left platform is in its first upright position.

4. The shelving system of claim 1 wherein the center platform further includes a right side panel and a left side panel disposed on opposite sides of and normally connected to the first and second horizontal panels of the center platform.

5. The shelving system of claim 4 wherein the right side panel of the center platform includes a hole.

6. The shelving system of claim 4 wherein the left side panel of the center platform includes a hole.

7. The shelving system of claim 1 wherein the center platform further includes a shelf disposed horizontally and between the first and second horizontal panels of the center platform is in the first upright position, the shelf providing a support disposed beneath the second horizontal panel and above the first horizontal panel of the center platform when the center platform is in the first upright position.

8. The shelving system of claim 1 wherein the right side vertical panel of the right platform includes a hole.

9. The shelving system of claim 1 wherein the left side vertical panel of the right platform includes a hole.

10. The shelving system of claim 1 wherein the right horizontal panel of the right platform further includes a first horizontal surface that engages the upper surface of the base when the right platform is in a first upright position, the right horizontal panel of the right platform further including a second inclined surface that faces away from the upper surface of the base when the right platform is in its first upright position, the second inclined surface of the right platform providing a support in an inclined position when the right platform is in its first upright position, the left horizontal panel of the left platform further includes a first horizontal surface that engages the upper surface of the base when the left platform is in a first upright position, the left horizontal panel of the left platform further including a second inclined surface that faces away from the upper surface of the base when the left platform is in its first upright position, the second inclined surface of the left platform providing a support in an inclined position when the left platform is in its first upright position, the center platform further includes a right side panel and a left side panel disposed on opposite sides of and normally connected to the first and second horizontal panels of the center platform, the right side panel of the center support being in juxtaposition with respect to the right side vertical panel of the right platform when center platform and the right platform are in their respective first upright positions, the left side panel of the center support being in juxtaposition with respect to the left side vertical panel of the left platform when center platform and the left platform are in their respective first upright positions.

11. The shelving system of claim 10 wherein the right side vertical panel of the right platform further includes a hole and the right side panel of the center platform further includes a hole, the holes of the right side vertical panel of the right platform and the right side panel of the center platform being in matching registry when the right and center platforms are in their respective first upright positions.

12. The shelving system of claim 10, wherein the left side vertical panel of the left platform further includes a hole and the left side panel of the center platform further includes a hole, the holes of the left side vertical panel of the left platform and the left side panel of the center platform being in matching registry when the left and center platforms are in their respective first upright positions.

13. The shelving system of claim 12 further including a grommet secured in the holes of the left side vertical panel of the left platform and the left side panel of the center platform when the left and center platforms are in their respective first upright positions.

14. The shelving system of claim 1 wherein the center platform is secured in place on the upper surface of the base by a tongue and groove connection.

15. The shelving system of claim 14 wherein the right and left platforms are secured to the center platform with removable alignment rods.

16. The shelving system of claim 1 wherein the upper surface of the base includes a slot and the first horizontal panel of the center platform includes an outer surface, said outer surface includes a cleat that is received in the slot of the upper surface of the base to hold the center platform in position on the base.

17. The shelving system of claim 1 wherein at least one of the first and second horizontal panels of the center platform includes a hole.

18. The shelving system of claim 1 wherein the left horizontal panel of the left platform further includes a first horizontal surface that engages the upper surface of the base when the left platform is in a first upright position, the left horizontal panel of the left platform further including a second inclined surface that faces away from the upper surface of the base when the left platform is in its first upright position, the second inclined surface of the left platform providing a support in an inclined position when the left platform is in its first upright position, the center platform further includes a right side panel and a left side panel disposed on opposite sides of and normally connected to the first and second horizontal panels of the center platform, the first horizontal panel of the center platform engages the upper surface of the base and the vertical panel of the center platform is proximal to the back edge of the base and the second horizontal panel of the center platform provides a horizontal support surface spaced vertically above the base when the center support is in a first upright position, the right side panel of the center support being in juxtaposition with respect to the right side vertical panel of the right platform when center platform and the right platform are in their respective first upright positions, the left side panel of the center support being in juxtaposition with respect to the left side vertical panel of the left platform when center platform and the left platform are in their respective first upright positions.

19. The shelving system of claim 18 wherein the right side vertical panel of the right platform further includes a hole and the right side panel of the center platform further includes a hole, the holes of the right side vertical panel of the right platform and the right side panel of the center platform being in matching registry when the right and center platforms are in their respective first upright positions.

20. The shelving system of claim 18 wherein the left side vertical panel of the left platform further includes a hole and the left side panel of the center platform further includes a hole, the holes of the left side vertical panel of the left platform and the left side panel of the center platform being in matching registry when the left and center platforms are in their respective first upright positions.

21. The shelving system of claim 20 further including a grommet secured in the holes of the left side vertical panel of the left platform and the left side panel of the center platform when the left and center platforms are in their respective first upright positions.

22. The shelving system of claim 1 wherein the right horizontal panel of the right platform further includes a first horizontal surface that engages the upper surface of the base when the right platform is in a first upright position, the right horizontal panel of the right platform further including a second inclined surface that faces away from the upper surface of the base when the right platform is in its first upright position, the second inclined surface of the right platform providing a support in an inclined position when the right platform is in its first upright position, the center platform further includes a right side panel and a left side panel disposed on opposite sides of and normally connected to the first and second horizontal panels of the center platform, the first horizontal panel of the center platform engages the upper surface of the base and the vertical panel of the center platform is proximal to the back edge of the base and the second horizontal panel of the center platform provides a horizontal support surface spaced vertically above the base when the center support is in a first upright position, the right side panel of the center support being in juxtaposition with respect to the right side vertical panel of the right platform when center platform and the right platform are in their respective first upright positions, the left side panel of the center support being in juxtaposition with respect to the left side vertical panel of the left platform when center platform and the left platform are in their respective first upright positions.

23. The shelving system of claim 22 wherein the right side vertical panel of the right platform further includes a hole and the right side panel of the center platform further includes a hole, the holes of the right side vertical panel of the right platform and the right side panel of the center platform being in matching registry when the right and center platforms are in their respective first upright positions.

24. The shelving system of claim 22 wherein the left side vertical panel of the left platform further includes a hole and the left side panel of the center platform further includes a hole, the holes of the left side vertical panel of the left platform and the left side panel of the center platform being in matching registry when the left and center platforms are in their respective first upright positions.

25. The shelving system of claim 24 further including a grommet secured in the holes of the left side vertical panel of the left platform and the left side panel of the center platform when the left and center platforms are in their respective first upright positions.

26. A shelving system for demonstrating audio visual components, the shelving system comprising:

a base, a center platform, a right platform, and a left platform, the base comprising a flat surface for supporting the center, right and left platforms with the center platform being disposed between the right and left platforms, the base comprising a front edge and a back edge, the center platform comprising a first horizontal panel and a second horizontal panel, the first and second horizontal panels being connected by a vertical panel, the first horizontal panel of the center platform engages the upper surface of the base and the vertical panel of the center platform is proximal to the back edge of the base and the second horizontal panel of the center platform provides a horizontal support surface for a component spaced vertically above the base when the center support is in a first upright position, the second horizontal panel of the center platform engages the upper surface of the base and the vertical wall is proximal to the front edge of the base and the first horizontal panel of the center platform provides a horizontal support surface for a component spaced vertically above the base when the center support is in a second inverted position, the center platform further comprises a right side panel and a left side panel disposed on opposite sides of and normally connected to the first and second horizontal panels of the center platform, the right platform comprising a right horizontal panel, a right side vertical panel and an right end vertical panel, the right horizontal panel comprising a side edge connected normally to the right side vertical panel, the right horizontal panel further comprising an end connected normally to the right end vertical panel, the right side vertical panel and right end vertical panel being connected normally together, the right horizontal panel of the right platform further comprises a first horizontal surface that engages the upper surface of the base when the right platform is in a first upright position, the right horizontal panel of the right platform further comprising a second inclined surface that faces away from the upper surface of the base when the right platform is in its first upright position, the second inclined surface of the right platform supporting a component in an inclined position when the right platform is in its first upright position, the right side panel of the center support being in juxtaposition with respect to the right side vertical panel of the right platform when center platform and the right platform are in their respective first upright positions, the left platform comprising a left horizontal panel, a left side vertical panel and an left end vertical panel, the left horizontal panel comprising a side edge connected normally to the left side vertical panel, the left horizontal panel further comprising an end connected normally to the left end vertical panel, the left side vertical panel and left end vertical panel being connected normally together, the left horizontal panel of the left platform further comprises a first horizontal surface that engages the upper surface of the base when the left platform is in a first upright position, the left horizontal panel of the left platform further comprising a second inclined surface that faces away from the upper surface of the base when the left platform is in its first upright position, the second inclined surface of the left platform supporting a component in an inclined position when the left platform is in its first upright position, the left side panel of the center support being in juxtaposition with respect to the left side vertical panel of the left platform when center platform and the left platform are in their respective first upright positions.

27. The shelving system of claim 26 wherein the center platform further comprises a shelf disposed horizontally and between the first and second horizontal panels when the center support is in the first upright position, the shelf providing support for a component disposed beneath the second horizontal panel and above the first horizontal panel of the center platform.

28. The shelving system of claim 26 wherein the right side vertical panel of the right platform further comprises a hole for accommodating component wiring and the right side panel of the center platform further comprises a hole for accommodating component wiring, the holes of the right side vertical panel of the right platform and the right side panel of the center platform being in matching registry when the right and center platforms are in their respective first upright positions.

29. The shelving system of claim 26 wherein the left side vertical panel of the left platform further comprises a hole for accommodating component wiring and the left side panel of the center platform further comprises a hole for accommodating component wiring, the holes of the left side vertical panel of the left platform and the left side panel of the center platform being in matching registry when the left and center platforms are in their respective first upright positions.

30. The shelving system of claim 29 further comprising a grommet secured in the holes of the left side vertical panel of the left platform and the left side panel of the center platform when the left and center platforms are in their respective first upright positions.

31. The shelving system of claim 26 wherein the center platform is secured in place on the upper surface of the base by a tongue and groove connection.

32. The shelving system of claim 31 wherein the right and left platforms are secured to the center platform with removable alignment rods.

33. The shelving system of claim 26 wherein the upper surface of the base comprises a slot and the first horizontal panel of the center platform comprises an outer surface, said outer surface comprises a cleat that is received in the slot of the upper surface of the base to hold the center platform in position on the base.

34. The shelving system of claim 26 wherein at least one of the first and second horizontal panels of the center platform comprise a hole for accommodating component wiring.

35. A shelving system comprising:

a base, a right platform, and a left platform, the right and left platforms being spaced apart on the base with a gap disposed therebetween, the base including a flat surface for supporting the center, right and left platforms with the center platform being disposed between the right and left platforms, the right platform including a right horizontal panel, a right side vertical panel and a right end vertical panel, the right horizontal panel including a side edge connected normally to the right side vertical panel, the right horizontal panel further including an end connected normally to the right end vertical panel, the right side vertical panel and right end vertical panel being connected normally together, the horizontal panel of the right platform further including a first horizontal surface that engages the upper surface of the base when the right platform is in a first upright position and that further provides a horizontal support in a position spaced vertically above the base when the right platform is in a second inverted position, the horizontal panel of the right platform further including a second inclined surface that faces away from the upper surface of the base when the right platform is in its first upright position, the second inclined surface of the right platform providing a support in an inclined position when the right platform is in its first upright position, the left platform including a left horizontal panel, a left side vertical panel and a left end vertical panel, the left horizontal panel including a side edge connected normally to the left side vertical panel, the left horizontal panel further including an end connected normally to the left end vertical panel, the left side vertical panel and left end vertical panel being connected normally together.

36. A shelving system comprising:

a base, a right platform, and a left platform, the right and left platforms being spaced apart on the base with a gap disposed therebetween, the base including a flat surface for supporting the center, right and left platforms with the center platform being disposed between the right and left platforms, the right platform including a right horizontal panel, a right side vertical panel and a right end vertical panel, the right horizontal panel including a side edge connected normally to the right side vertical panel, the right horizontal panel further including an end connected normally to the right end vertical panel, the right side vertical panel and right end vertical panel being connected normally together, the left platform including a left horizontal panel, a left side vertical panel and a left end vertical panel, the left horizontal panel including a side edge connected normally to the left side vertical panel, the left horizontal panel further including an end connected normally to the left end vertical panel, the left side vertical panel and left end vertical panel being connected normally together, the horizontal panel of the left platform further including a first horizontal surface that engages the upper surface of the base when the left platform is in a first upright position and that further provides a horizontal support in a position spaced vertically above the base when the left platform is in a second inverted position, the horizontal panel of the left platform further including a second inclined surface that faces away from the upper surface of the base when the left platform is in its first upright position, the second inclined surface of the left platform providing a support in an inclined position when the left platform is in its first upright position.

37. A shelving system comprising:

a base, a center platform, a right platform, and a left platform, the base including a flat surface for supporting the center, right and left platforms with the center platform being disposed between the right and left platforms, the center platform including a first horizontal panel and a second horizontal panel, the first and second horizontal panels of the center platform being connected by a vertical panel, the right platform including a right horizontal panel, a right side vertical panel and a right end vertical panel, the right horizontal panel including a side edge connected normally to the right side vertical panel, the right horizontal panel further including an end connected normally to the right end vertical panel, the right side vertical panel and right end vertical panel being connected normally together, the right horizontal panel of the right platform further including a first horizontal surface that engages the upper surface of the base when the right platform is in a first upright position and that further provides a horizontal support in a position spaced vertically above the base when the right platform is in a second inverted position, the right horizontal panel of the right platform further including a second inclined surface that faces away from the upper surface of the base when the right platform is in its first upright position, the second inclined surface of the right platform providing a support in an inclined position when the right platform is in its first upright position, the left platform comprising a left horizontal panel, a left side vertical panel and a left end vertical panel, the left horizontal panel including a side edge connected normally to the left side vertical panel, the left horizontal panel further including an end connected normally to the left end vertical panel, the left side vertical panel and left end vertical panel being connected normally together.

38. The shelving system of claim 37 wherein the left horizontal panel of the left platform further includes a first horizontal surface that engages the upper surface of the base when the left platform is in a first upright position and that further provides a horizontal support in a position spaced vertically above the base when the left platform is in a second inverted position, the left horizontal panel of the left platform further including a second inclined surface that faces away from the upper surface of the base when the left platform is in its first upright position, the second inclined surface of the left platform providing a support in an inclined position when the left platform is in its first upright position.

39. The shelving system of claim 37 wherein the center platform further includes a right side panel and a left side panel disposed on opposite sides of and normally connected to the first and second horizontal panels of the center platform.

40. The shelving system of claim 39 wherein the right side panel of the center platform includes a hole.

41. The shelving system of claim 39 wherein the left side panel of the center platform includes a hole.

42. The shelving system of claim 37 wherein the base includes a front edge and a back edge, and the first horizontal panel of the center platform engages the upper surface of the base and the vertical panel of the center platform is proximal to the back edge of the base and the second horizontal panel of the center platform provides a horizontal support surface spaced vertically above the base when the center support is in a first upright position, and the second horizontal panel of the center platform engages the upper surface of the base and the vertical wall is proximal to the front edge of the base and the first horizontal panel of the center platform provides a horizontal support surface spaced vertically above the base when the center support is in a second inverted position.

43. The shelving system of claim 37 wherein the center platform further includes a shelf disposed horizontally and between the first and second horizontal panels when the center support is in the first upright position, the shelf providing a support disposed beneath the second horizontal panel and above the first horizontal panel of the center platform.

44. The shelving system of claim 37 wherein the right side vertical panel of the right platform includes a hole.

45. The shelving system of claim 37 wherein the left side vertical panel of the left platform includes a hole.

46. The shelving system of claim 37 wherein the center platform is secured in place on the upper surface of the base by a tongue and groove connection.

47. The shelving system of claim 46 wherein the right and left platforms are secured to the center platform with removable alignment rods.

48. The shelving system of claim 37 wherein the upper surface of the base includes a slot and the first horizontal panel of the center platform includes an outer surface, said outer surface includes a cleat that is received in the slot of the upper surface of the base to hold the center platform in position on the base.

49. The shelving system of claim 37 wherein at least one of the first and second horizontal panels of the center platform comprise a hole.

50. A shelving system comprising:

a base, a center platform, a right platform, and a left platform, the base including a flat surface for supporting the center, right and left platforms with the center platform being disposed between the right and left platforms, the center platform including a first horizontal panel and a second horizontal panel, the first and second horizontal panels of the center platform being connected by a vertical panel, the right platform including a right horizontal panel, a right side vertical panel and a right end vertical panel, the right horizontal panel including a side edge connected normally to the right side vertical panel, the right horizontal panel further including an end connected normally to the right end vertical panel, the right side vertical panel and right end vertical panel being connected normally together, the left platform including a left horizontal panel, a left side vertical panel and a left end vertical panel, the left horizontal panel including a side edge connected normally to the left side vertical panel, the left horizontal panel further including an end connected normally to the left end vertical panel, the left side vertical panel and left end vertical panel being connected normally together, the left horizontal panel of the left platform further including a first horizontal surface that engages the upper surface of the base when the left platform is in a first upright position and that further provides a horizontal support in a position spaced vertically above the base when the left platform is in a second inverted position, the left horizontal panel of the left platform further including a second inclined surface that faces away from the upper surface of the base when the left platform is in its first upright position, the second inclined surface of the left platform providing a support in an inclined position when the left platform is in its first upright position.

51. The shelving system of claim 50 wherein the right horizontal panel of the right platform further includes a first horizontal surface that engages the upper surface of the base when the right platform is in a first upright position and that further provides a horizontal support in a position spaced vertically above the base when the right platform is in a second inverted position, the right horizontal panel of the right platform further including a second inclined surface that faces away from the upper surface of the base when the right platform is in its first upright position, the second inclined surface of the right platform providing a support in an inclined position when the right platform is in its first upright position.

52. The shelving system of claim 50 wherein the center platform further includes a right side panel and a left side panel disposed on opposite sides of and normally connected to the first and second horizontal panels of the center platform.

53. The shelving system of claim 52 wherein the right side panel of the center platform includes a hole.

54. The shelving system of claim 52 wherein the left side panel of the center platform includes a hole.

55. The shelving system of claim 52 wherein the base includes a front edge and a back edge, and the first horizontal panel of the center platform engages the upper surface of the base and the vertical panel of the center platform is proximal to the back edge of the base and the second horizontal panel of the center platform provides a horizontal support surface spaced vertically above the base when the center support is in a first upright position, and the second horizontal panel of the center platform engages the upper surface of the base and the vertical wall is proximal to the front edge of the base and the first horizontal panel of the center platform provides a horizontal support surface spaced vertically above the base when the center support is in a second inverted position.

56. The shelving system of claim 50 wherein the center platform further includes a shelf disposed horizontally and between the first and second horizontal panels when the center support is in the first upright position, the shelf providing a support disposed beneath the second horizontal panel and above the first horizontal panel of the center platform.

57. The shelving system of claim 50 wherein the right side vertical panel of the right platform includes a hole.

58. The shelving system of claim 50 wherein the left side vertical panel of the left platform includes a hole.

59. The shelving system of claim 50 wherein the center platform is secured in place on the upper surface of the base by a tongue and groove connection.

60. The shelving system of claim 59 wherein the right and left platforms are secured to the center platform with removable alignment rods.

61. The shelving system of claim 50 wherein the upper surface of the base includes a slot and the first horizontal panel of the center platform includes an outer surface, said outer surface includes a cleat that is received in the slot of the upper surface of the base to hold the center platform in position on the base.

62. The shelving system of claim 50 wherein at least one of the first and second horizontal panels of the center platform comprise a hole.

* * * * *